US007510518B2

(12) United States Patent
Heinen et al.

(10) Patent No.: US 7,510,518 B2
(45) Date of Patent: Mar. 31, 2009

(54) METHOD FOR MAKING STANDING FOLDS AND KNIFE FOLDING MACHINE WITH WORK TRANSFER DEVICE

(75) Inventors: Arno Heinen, Ascheberg-Herben (DE); Roland Pietschmann, Berlin (DE); Peter Rieckhoff, Berlin (DE); Detlef Rothgänger, Berlin (DE); Michael Sperling, Berlin (DE); Frank Matecka, Berlin (DE)

(73) Assignee: Karl Rabofsky GmbH, Berlin (DE)

( * ) Notice: Subject to any disclaimer, the term of this patent is extended or adjusted under 35 U.S.C. 154(b) by 589 days.

(21) Appl. No.: 11/131,588

(22) Filed: May 18, 2005

(65) Prior Publication Data

US 2005/0257655 A1 Nov. 24, 2005

(30) Foreign Application Priority Data

May 21, 2004 (DE) ..... 10 2004 025 501

(51) Int. Cl.
*B31F 1/14* (2006.01)

(52) U.S. Cl. ..... 493/448; 493/451; 493/463

(58) Field of Classification Search ..... 493/42, 493/43, 45, 463, 451, 448; 270/32, 39.05, 270/39.08

See application file for complete search history.

(56) References Cited

U.S. PATENT DOCUMENTS 3,127,341 A * 3/1964 Abeles ..... 210/493.3
3,161,557 A * 12/1964 Muller ..... 156/462
3,383,449 A * 5/1968 Muller ..... 264/287
4,201,119 A * 5/1980 Wolf ..... 493/457
4,938,739 A * 7/1990 Nilsson ..... 493/422
5,200,013 A * 4/1993 Traber ..... 156/210
5,211,091 A * 5/1993 Cole ..... 83/69
5,230,455 A * 7/1993 Price ..... 226/88
5,405,483 A * 4/1995 Neff ..... 156/379.8
6,022,305 A * 2/2000 Choi et al. ..... 493/463
6,113,784 A * 9/2000 Stoyell et al. ..... 210/493.2
6,254,523 B1 * 7/2001 Yamamoto et al. ..... 493/451
6,290,635 B1 * 9/2001 Demmel et al. ..... 493/399

(Continued)

FOREIGN PATENT DOCUMENTS

DE 19538519 4/1997

(Continued)

*Primary Examiner*—Paul R Durand
(74) *Attorney, Agent, or Firm*—Mark P. Stone

(57) ABSTRACT

The invention relates to a method for making standing folds in a material web and a knife folding machine (1) for producing such standing folds. The knife folding machine has at least two folding knives (2, 3), which are situated one opposite the other with respect to the material web (4). A folding channel (5) extends from the folding knives (2, 3) in the folding direction (F). In order to reduce the costs involved in resetting the knife folding machine (1) to other material webs (4) to be folded or at the end of a material web (4), a work transfer device (14) is provided, which, in an ejection mode, has a stop (24) which juts into the projection area of the standing folds (26) in the folding channel (5) in the folding direction (F). As a result of the work transfer device (14), the standing fold parcel (26) in the folding channel (5) is able to be ejected and to be further processed in normal fashion by following appliances, without waste being incurred.

18 Claims, 2 Drawing Sheets

U.S. PATENT DOCUMENTS

| | | | | |
|---|---|---|---|---|
| 6,416,562 | B1 * | 7/2002 | Shibuya et al. | 55/486 |
| 6,685,615 | B2 * | 2/2004 | Weder | 493/463 |
| 6,942,895 | B2 * | 9/2005 | Schneider et al. | 427/289 |
| 2005/0257655 | A1 * | 11/2005 | Heinen et al. | 83/401 |

FOREIGN PATENT DOCUMENTS

| | | |
|---|---|---|
| DE | 19746734 | 4/1999 |

* cited by examiner

METHOD FOR MAKING STANDING FOLDS AND KNIFE FOLDING MACHINE WITH WORK TRANSFER DEVICE

The invention relates to a method for making standing folds in a material web fed in a folding direction, the standing folds being produced by at least two folding knives, which are situated one opposite the other with respect to the material web, and being forced into a folding channel. The invention further relates to a knife folding machine for producing standing folds in a material web fed in a folding direction, having at least two folding knives, which are situated one opposite the other with respect to the material web, and having a folding channel extending from the folding knives in the folding direction.

Knife folding machines of this type are known. Thus, in DE-A-195 38 519, a knife folding machine having the above features is described. In the case of this knife folding machine, at least three servo motors are provided for the driving of the folding knives and a further servo motor uses a moving pressure plate, which forms a wall of the folding channel, to control the counterpressure against which the folding knives, in the course of the folding motion, force the standing folds through the folding channel. The folding channel can be provided with a heating device, so that the standing folds, directly after the folding, are subjected to a heat treatment and are thereby fixed.

Knife folding machines of this type are used, for example, for folding air filters made from a wide variety of materials such as woven fabrics, but also metal gauzes. From the folding channel, the standing folds are usually conducted for further working to machines situated downstream. The subsequent machining is realized at the same speed at which the standing folds are produced, so that intermediate storage of the standing folds can be waived.

Following completion of the folding process, when the material web is at an end or has to be exchanged for another material web, a standing fold parcel is still present in the folding channel. In order to remove this standing fold parcel from the folding channel, it has hitherto been the case that either the standing fold parcel has to be manually removed, or the folding process has to be continued, with the original material or with an auxiliary material, beyond the truly required quantity of standing folds, so that the standing fold parcel is transported out of the folding channel in the course of folds being made in the new material web.

This procedure is disadvantageous, however, for several reasons: on the one hand, the manual removal, which is generally preceded by a cooling of the heating device in the folding channel, adds unnecessarily to the set-up times; on the other hand, with very expensive material webs, it is uneconomical to throw away the standing fold parcel which, at the end or at the change of material web, is still present in the folding channel.

On the basis of these drawbacks, the object is formulated of improving the known knife folding machines and the known methods for making standing folds, such that, upon completion of the folding operation, a quick re-setting can be effected with no unnecessary material consumption and with the possibility of almost uninterrupted further processing of the created standing folds.

For the method stated in the introduction, this object is achieved according to the invention by the fact that, following the folding operation, the standing fold parcel present in the folding channel is pushed out of the folding channel in the folding direction by a work transfer device.

For the knife folding machine stated in the introduction, this object is achieved according to the invention by the fact that a work transfer device is provided, which has a stop which juts into at least a part of the projection area, in the folding direction, of the standing folds in the folding channel and is configured such that it can be driven through the folding channel in the folding direction.

The solution according to the invention is simple. It allows, following completion of the folding operation and upon a change of material web in the middle of the folding operation, the standing fold parcel still present in the folding channel to be transported out of the folding channel and fed to the further processing steps without manual removal, i.e. without substantial lengthening of the resetting times. For this purpose, the knife folding machine is provided with a work transfer device, the stop of which juts into the folding channel and hence, as it moves, transports the standing fold parcel in the folding direction.

In order to be able to further process the ejected standing fold parcel in an essentially continuous manner by virtue of the peripheral equipment situated downstream of the knife folding machine, in an advantageous embodiment the ejection speed of the standing fold parcel can essentially correspond to the folding speed at which the standing folds are produced in the folding channel during normal operation of the knife folding machine. Preferably, the ejection speed can be variably presettable, so that it is adjustable to different folding speeds.

It is also of advantage if the work transfer device can be transferred from an ejection position, in which the stop, in the folding direction, overlaps with the standing folds in the folding channel, into a folding operation mode, in which the stop is disposed in the folding direction essentially outside the projection area of the standing folds, preferably outside the cross section of the folding channel in a direction at right angles to the folding direction, i.e. can no longer collide with the standing folds as these are being made. With this measure, the folding operation can take place without disturbance in the rest position of the work transfer device.

In order to eject or push the standing fold parcel out of the folding channel following completion of the folding operation, the stop can be moved prior to the ejection, in the folding direction, in front of the folding knives and thus in front of the entire standing fold parcel in the folding channel. For this purpose, the work transfer device has a stroke which extends to in front of the folding knives in the folding direction. This embodiment serves to ensure that the entire standing fold parcel in the folding channel can be transported from the folding knives out of the folding channel.

In a further advantageous embodiment, at least one folding knife can be moved in front of the folding channel prior to the start of the ejection operation. Following completion of the folding operation, the standing folds are prevented from collapsing by the folding knife moved in front of the folding channel, since the folding pressure is maintained by the folding knife and compresses the standing folds. After the stop is moved against the folding knife, the folding knife can then be withdrawn essentially transversely to the folding direction, so that the stop now holds the folds together following withdrawal of the folding knife and moves them out of the folding channel.

According to a further advantageous embodiment, during the ejection operation, the stop can be moved in the folding direction with an essentially constant ejection force. The ejection force can be controlled or regulated by a control unit of the knife folding machine at a value which is constant, yet can be variably preset. Such a force control can be effected, for example, via a torque control of a drive motor, such as a servo motor, which drives the stop by means via a traction means gear, such as a toothed belt, belt or chain drive. The stop can also, however, be driven via linear motors, elevating screw gears or lifting cylinders, such as pneumatic or hydraulic cylinders.

It is of quite particular advantage if, in a further embodiment, the work transfer device can simultaneously be used, at the start of the folding operation, to generate the counterpressure, directed counter to the folding direction, which is necessary to establish and maintain the standing folds produced by the folding knives. The counterpressure forms a defined resistance against which the folding knives work and is a prerequisite for a neat fold formation. The counterpressure reacts through the standing fold parcel upon the folding knives, which, during the folding operation, generate the folding pressure acting in the folding direction.

In running operation, if the standing fold parcel extends through the entire folding channel also over the pressure plate, the counterpressure is generated by the pressure plate being forced against the standing folds, so that the bent lines of the standing folds are exposed to increased friction during the motion through the folding channel. This friction leads to the counterpressure. At the start of the folding operation, however, the standing fold parcel does not yet extend to the pressure plate and there are not yet sufficient standing folds produced to lead to an adequate friction resistance and thus to an adequate counterpressure.

Hence, at the start of the folding operation, the counterpressure has hitherto been generated with a set of counterpressure pads, which are manually inserted and aligned. With an increasing number of standing folds in the folding channel, individual pads have to be removed to make space in the folding channel for the standing folds. The dimensions of the used counterpressure pads are dependent on the width of the material web to be folded and the width of the folding channel, and the fold heights and the height of the folding channel, which can measure between 3 mm and 200 mm.

As a result of the simultaneous use of the work transfer device as a counterpressure device and as an ejection device, the troublesome use of counterpressure pads is no longer necessary. All control and drive modules of the work transfer device can be used to generate the counterpressure.

Thus, the work transfer device can be configured such that it can be transferred into a counterpressure mode, in which case, in the counterpressure mode, during the folding motion of the folding knives, a counterpressure can be generated, which is directed counter to the folding direction and acts upon at least the standing folds in the folding channel. For the generation of the counterpressure, the work transfer device can especially comprise a contact-pressure element, which, in the counterpressure mode, juts into the projection area, in the folding direction, of the standing folds in the folding channel. As the contact-pressure element, it is possible to use, for example, the stop which is used to eject the standing fold parcel following completion of the folding operation. The counterpressure mode can be adopted especially at the start of the folding operation, when the first standing folds are produced in a new material web.

The contact-pressure element can further be designed to be switchable into a rest position, in which it is disposed outside the projection area, in the folding direction, of the standing folds and cannot therefore collide with the standing folds in the folding channel and prevent the folding operation.

At the start of the folding operation, the work transfer device can be moved with the contact-pressure element initially counter to the folding direction from the folding channel toward the closed folding knives covering the folding channel. Since the counterpressure is dependent on the geometry of the standing folds and, in particular, on the material used in the material web, the motion of the work transfer device in the counterpressure mode is preferably performed in a force-controlled manner, i.e. with a counterpressure force which is adjustable on a predetermined basis. In this control system, the contact-pressure means automatically stops if it presses against the folding knives. After the folding knives have been started up, they commence the folding motion.

With the start of the folding process, the standing folds are pressed from the folding knives against the stop and the work transfer device now operates, in contrast to the ejection mode, in a braking operation against the folding pressure generated by the folding knives and directed in the folding direction. If the folding pressure exceeds the counterpressure, then the work transfer device is forced in the folding direction and makes space for the new standing folds in the folding channel.

The invention is explained in greater detail below on the basis of an illustrative embodiment with reference to the figures. The specific configuration of the described illustrative embodiment serves only as an illustration, the features described, for illustrative purposes, in the illustrative embodiment not necessarily having to appear together in this combination. Rather, individual features can additionally be provided and other features omitted, as is apparent from the above general description of the possible embodiments.

Figure 1:
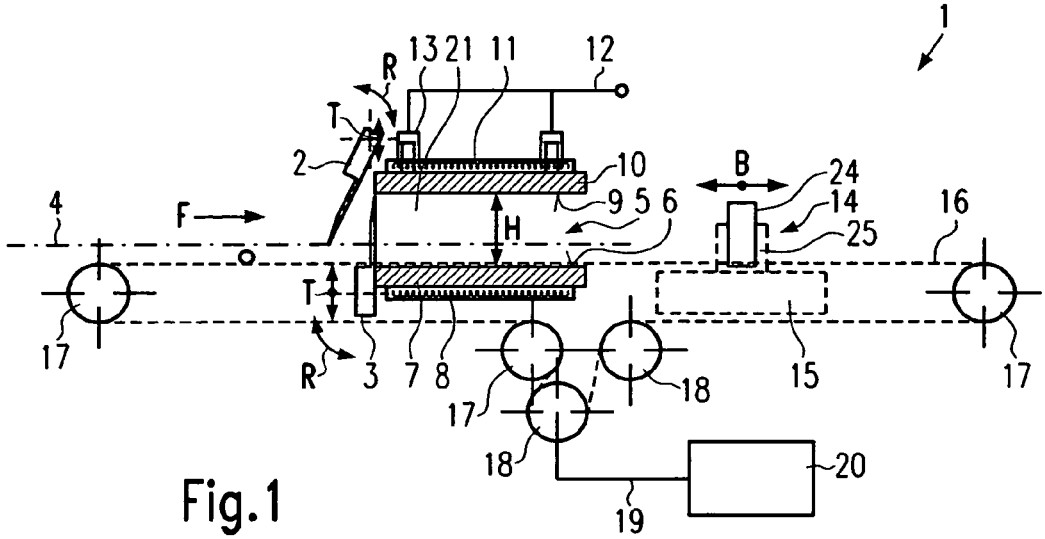
FIG. 1 shows a diagrammatic representation of a knife folding machine according to the invention in a side view.

Firstly, the structure of an illustrative embodiment of a knife folding machine 1 according to the invention is represented with reference to the diagrammatic representation of FIG. 1. In FIG. 1, for the sake of simplicity, only those features of the knife folding machine 1 are represented which are necessary to an understanding of the invention. Regarding the other elements of the knife folding machine 1 which are not represented in FIG. 1, reference is made to DE-A-195 38 519, which is alluded to in full measure.

The knife folding machine 1 has an upper folding knife 2 and a lower folding knife 3, which are situated one opposite the other with respect to an imaginary plane 4 of a material web to be folded (not represented in FIG. 1). During operation, the folding knives 2, 3 perform a folding motion, by which the standing folds are produced. Each of the two folding knives 2, 3 can perform, independently of each other, a rotary motion R and a translatory motion T. The material web to be folded is fed through the knife folding machine 1 in a folding direction F.

In the folding direction F, a folding channel 5 is disposed behind the folding knives 2, 3, which folding channel preferably directly adjoins the folding knives 2, 3 in the folding direction F.

In the illustrative embodiment of FIG. 1, a floor area 6 of the folding channel 5 is formed by a machine table 7, which can be heated by a heating device 8. A cover 9 of the folding channel 5 is limited by a pressure plate 10, which can be configured such that it can likewise be heated by a further heating device 11. The pressure plate 10 is movable transversely to the folding direction F via an adjusting device 12.

As represented in FIG. 1, the adjusting device 12 can alter for example, via pneumatic cylinders 13, a height H of the folding channel transversely to the folding direction F. In place of a pneumatic adjusting device 12, it is also possible to use an adjusting device using a computer-controlled servo motor, as is described in DE-A-195 38 519. In the folding direction F, the folding channel 5 is adjoined by further machining tools, such as, for example, cutting machines, which, for the sake of clarity, are not however shown in FIG. 1.

The folding machine 1 is further provided with a work transfer device 14, which is driven such that it is movable parallel to the folding direction F in and counter to the folding direction F, as is indicated by the double arrow B. The work transfer device, 14 comprises at least one slide 15, which is driven in translatory motion by means of a servo motor 18, via a toothed belt 16 and toothed belt rollers 17. In place of a traction means drive of this kind, other drive forms may also be used, insofar as an essentially translatory motion in the direction of the double arrow B and parallel to the folding direction F is possible. For example, linear motors, elevating screw gears, lifting cylinders, such as, for example, pneumatic cylinders or hydraulic cylinders, and other traction means drives, such as belt or chain drives, may be used.

The servo motor 18 is connected by a control line 19 to a control unit 20. The control unit 20 comprises a computer and/or integrated circuit and monitors respectively, via a path sensor and/or a force sensor (not shown in FIG. 1), the motion and the drive force, and the torque of the drive motor 18, and directly the position of the slide 15 and the forces acting thereon in the motional direction.

In the operating position of the knife folding machine represented in FIG. 1, the inlet of the folding channel 5 is closed off by the lower folding knife 3, while the upper folding knife is moved in translatory motion upward out of the overlap with the folding channel 5 and is swung up in rotary motion counter to the folding direction F.

Figure 2:
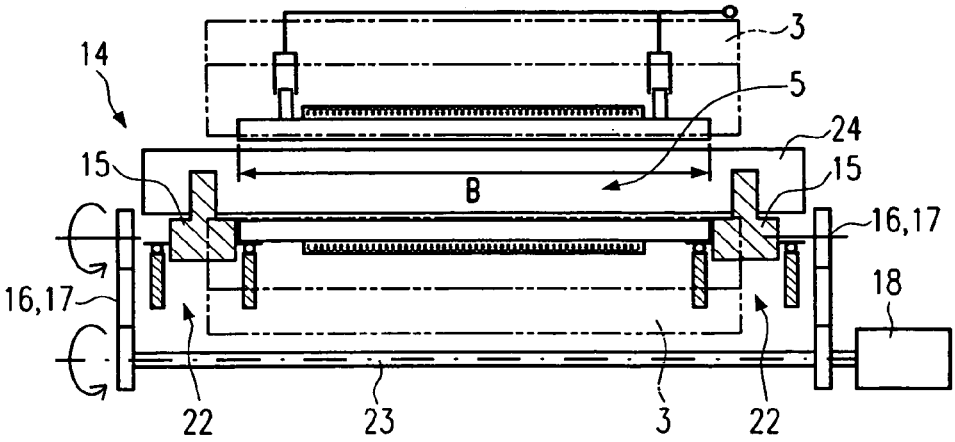
FIG. 2 shows the knife folding machine of FIG. 1 in a diagrammatic front view.

In the front view of the knife folding machine 1 according to FIG. 2, the folding knives 2, 3 are represented only in phantom lines, for the sake of clarity. It can be seen that the folding channel 5 is open at the sides and the two folding knives extend over the entire width W of the folding channel 5.

It can further be seen that, in the represented embodiment, the work transfer device 14 has two slides 15, which run on both sides of the folding channel 5, respectively in straight-line guides 22. The straight-line guides 22 extend parallel to the folding direction F. Each of the two slides 15 is assigned a traction means drive 16, 17. The two traction means drives 16, 17 are driven jointly by the servo motor 18, via a common drive shaft 23.

In place of two slides 15 on both sides of the folding channel 5, an individual slide can also, of course, be used, which can easily lead, however, to an asymmetric load. Similarly, more than two slides can be used, which is more complex, however, with respect to the precise parallel alignment of the straight-line guides connected to the slides.

The work transfer device 14 further has a stop 24, which is represented in cross section in FIG. 1. As can be seen in FIG. 2, the stop 24 juts into the cross section of the folding channel 5. In particular, in the case of two slides 15 disposed to the left and right of the folding channel, as shown in FIG. 2, the stop 24 can extend transversely to the folding direction over the entire width of the folding channel 5 from the one slide 15 to the other slide 15. In this case, the stop 24 is configured, for example, like a bar or a rail. The height of the stop 24 preferably corresponds to the height H of the folding channel 5.

The stop 24 is fastened to the work transfer device 14 in such a way that it can be moved out of the cross section of the folding channel 5 and the projection of the cross section of the folding channel 5 in the folding direction and thus no longer impedes the folding operation. This can most simply be realized, for example, by the stop 24 being manually attachable to the work transfer device 14 and being configured such that it can be repeatedly removed. For the fastening of the stop 24, the work transfer device can have a corresponding mounting, for example a U-shaped receiving fixture 25 which is open in the direction of furnishment. The two-branches of the receiving fixture are disposed in front of and behind the stop in the folding direction. In place of a manual removal and movement of the stop, an automatic movement can also be provided. In the case of a manually fastenable stop 24, as represented as a bar in FIG. 2, a work transfer device 14 can be assigned a plurality of different stops, which respectively have different heights and allow an adjustment to different fold heights and heights H of the folding channel 5.

The functioning of the knife folding machine 1 according to the invention is explained in greater detail below with reference to FIGS. 3 to 5.

Figure 3:
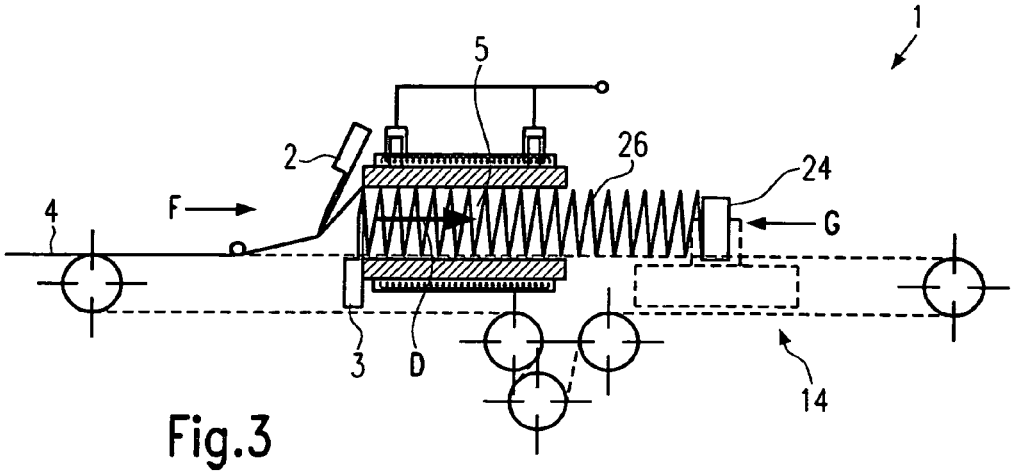
FIG. 3 shows a diagrammatic side view of the illustrative embodiment of FIGS. 1 and 2 in a counterpressure mode.

FIG. 3 shows the start of a folding operation, in which, in the material web 4, standing folds 26 are produced by the folding knives 2, 3. At the start of the folding operation, the work transfer device 14 is operated in a counterpressure mode, in which a counterpressure G is generated, directed counter to the folding direction F. The folding knives 2, 3 work against the counterpressure G and, in so doing, generate a folding pressure D, so that the standing fold parcel present in the folding channel 5 stands up.

The more folds are forced by the folding knives 2, 3 into the folding channel 5, the more the work transfer device 14 yields in the folding direction F, since the folding pressure D exceeds the counterpressure G. The control unit 20 (FIG. 1) controls the drive motor 18 in the counterpressure mode such that the counterpressure G essentially remains constant. For this purpose, the drive motor 18 is operated as a braking device, which absorbs the folding pressure generated by the folding knives 2, 3.

If the knife folding machine 1 is furnished with a new material web 4 and if the material of the material web 4 is changed, then the folding channel 5, at the start of this new folding operation, is initially empty. In this case, the work transfer device 14 is transferred initially into the counterpressure mode, in which the stop 24 is moved into a position in which it juts into the folding channel 5, preferably into the projection area, in the folding direction F, of the standing folds 26 to be produced. In this position, the stop 24 overlaps in the folding direction F the standing folds 26 which are yet to be produced. For this purpose, an operator can place into the work transfer device 14, for example, a stop 24 with a height corresponding to the height H of the folding channel 5. The stop 24 is then moved from the folding channel 5 toward the closed folding knives 2, 3. Because of the control of force by the control unit 20, i.e. the movement of the work transfer device 14 with a constant force G, the stop automatically stops as it drives up against the folding knives 2, 3.

As soon as the folding knives commence the folding motion, the first standing fold is pressed against the counterpressure bar. If the folding pressure D exceeds the counterpressure G, when a standing fold is forced by the folding knives 2, 3 into the folding channel, then the stop is moved in the folding direction F.

Via the control unit 20, the level of the counterpressure G can be adjusted to the geometry of the standing folds 26 and to the characteristics of the material web 4 to be folded. Rigid materials normally need a higher counterpressure than softer materials.

Figure 4:
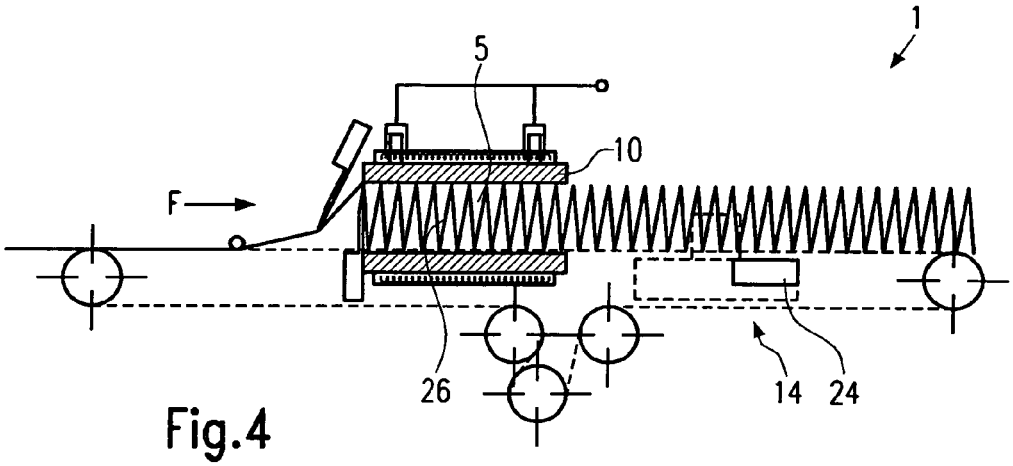
FIG. 4 shows a diagrammatic side view of the illustrative embodiment of FIGS. 1 and 2 in a folding operation mode.
Figure 5:
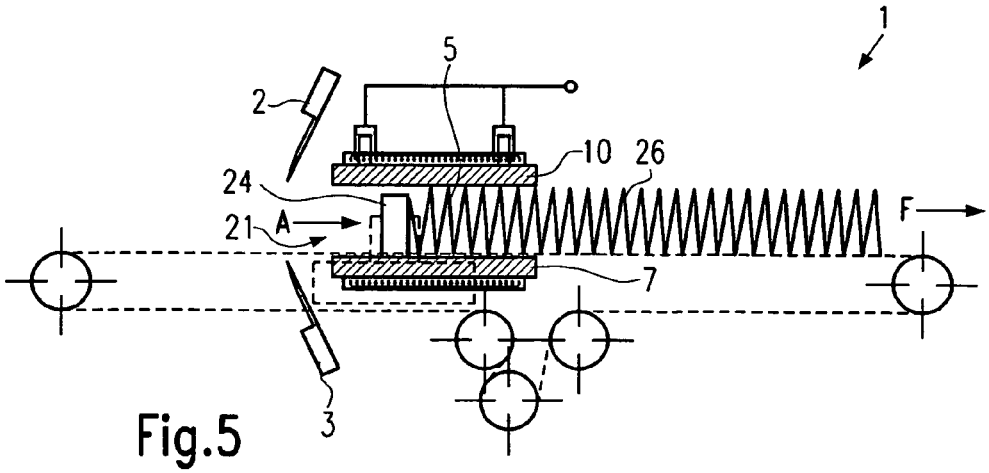
FIG. 5 shows a diagrammatic side view of the illustrative embodiment of FIGS. 1 and 2 in an ejection mode.

FIG. 4 shows the work transfer device 14 in a folding operation mode, in which the stop 24 is moved out of the overlap with the folding channel 5 and the projection of the cross section of the folding channel 5 in the folding direction or the projection of the standing folds 26 in the folding direction, so that it can no longer collide with the standing folds 26 and does not impede the folding operation. In this mode of action of the work transfer device 14, the standing folds 26 can be made without hindrance and are continuously fed to downstream machining steps. The counterpressure G which is necessary to make the standing folds 26 is now generated by the pressure plate 10 and the adjusting device 12. In addition, the counterpressure can be generated by a pneumatic cylinder.

If the material web 4 ends or if the material web 4 is changed due to a production shift, then a standing fold parcel 26 is left in the folding channel 5. In order to push the standing fold parcel out of the folding channel 5, the work transfer device 14 is transferred into the ejection mode represented in FIG. 5.

For this purpose, the work transfer device 14 is moved counter to the folding direction F to in front of the inlet 21 of the folding channel 5 and the folding knives 2, 3. The folding knives 2, 3 hereupon remain closed with maintenance of the folding pressure D, while the pressure plate 10 maintains the counterpressure, so that the standing fold parcel in the folding channel 5 retains its shape.

In front of the closed folding knives 2, 3 in the folding direction F, the stop 24 is then transferred into a position in which it at least partially overlaps in the folding direction F with the projection of the standing fold parcel in the folding direction F and juts into the projection of the cross section of the folding channel 5 in the folding direction F. Thus, the stop 24 is moved in front of the folding knives 2, 3 in the folding direction F. For example, a bar 24 is inserted into the receiving fixture 25. The stop 24 is now moved in the folding direction F against the closed folding knives 2, 3. This motion preferably takes place under the control of the control unit 20 with constant drive force of the servo motor 18. As is shown in FIG. 5, the folding knives are then opened by being initially moved up and down in a translatory motion along the double arrows T (FIG. 1) transversely to the folding direction F and then being swung up in rotary motion along the double arrows R. Due to the force control, the work transfer device, as soon as the folding knives are opened, presses the stop 24 automatically against the standing fold parcel in the folding channel 5. The standing fold parcel in the folding channel 5 is conveyed in the folding direction F out of the folding channel and, where necessary, into a following machine for further processing.

The speed of advance of the work transfer device 14 in the ejection mode is adjustable and is preferably identical with the advance of the standing folds 26 during the folding operation, the folding speed. The speed of advance of the stop 24 can also be adjusted by the control unit 20 to a processing speed of a following machine, which processing speed is different from the folding speed.

After the folding channel 5 has been emptied, the stop 24 is located on the outlet side of the folding channel situated in the folding direction F. In order to start the folding operation with a new material web 4, the work transfer device 14 can be transferred out of this position, without movement of the stop 24, into the counterpressure mode as described above with reference to FIG. 3. For this purpose, only a new material web has to be inserted and the folding knives 2, 3 have to be closed.

Of course, deviations from the illustrative embodiment are possible within the inventive concept. Thus, the folding channel 5 does not have to be closed simultaneously by the two folding knives 2, 3 when the counterpressure mode or the ejection mode is adopted by the work transfer device 14, it is also possible for just one folding knife 2 or 3 to be moved into the closing position.

Finally, for the effect according to the invention, the precise form of the stop 24 is not important. Basically, it is not necessary for the stop 24 to extend over the entire surface of the standing folds transversely to the folding direction F. In order, however, to achieve a uniform effect of the counterpressure G in the counterpressure mode and of the ejection force A in the press-out mode and not to impair the quality of the standing folds 26, it is advantageous if the stop 24 covers as large an area as possible of the standing folds 26. Alternatively, the stop 24 can, however, be configured as a finger-shaped, disk-shaped or plate-shaped driver.

This invention claimed is:

1. A method for making standing folds (26) in a material web (4) fed in a folding direction (F), the standing folds (26) being produced by at least two folding knives (2, 3), which are situated one opposite the other with respect to the material web (4), and being forced into a folding channel (5), wherein, following completion of the folding operation, the standing fold parcel present in the folding channel (5) is ejected from the folding channel (5) in the folding direction (F) by a work transfer device (14), and prior to the ejection, a stop (24) of the work transfer device (14) is moved in front of the folding knives (2, 3) in the folding direction (F).

2. The method as claimed in claim 1, wherein following completion of the folding operation, the standing fold parcel is ejected from the folding channel (5) at approximately the folding speed.

3. The method as claimed in claim 1, wherein, prior to the ejection of the standing fold parcel, said stop (24) is brought into overlap with a projection in the folding direction (F) of the cross section of the standing fold parcel.

4. The method as claimed in claim 1, wherein, prior to the ejection of the standing fold parcel, at least one said folding knife (2, 3) is moved in front of the folding channel (5), whereafter, in the folding direction (F), a said stop (24) is moved against said at least one folding knife (2, 3).

5. The method as claimed in claim 4, wherein the stop (24) is moved in the folding direction (F) with an essentially constant ejection force (A).

6. The method as claimed in claim 1, wherein the work transfer device (14), in a counterpressure mode, at least at the start of the folding operation, generates a counterpressure force (G), which is directed counter to the folding direction (F) and which, at least in the folding channel (5), acts upon the standing folds (26).

7. The method as claimed in claim 6, wherein prior to the start of the folding operation, at least one said folding knife (2, 3) is moved into a closing position in front of the folding channel (5).

8. The method as claimed in claim 6, wherein, in the counterpressure mode, the stop (24) of the work transfer device (14) is brought into overlap with at least a part of the projection area of the standing folds (26) in the folding channel (5) in the folding direction (F).

9. The method as claimed in claim 8, wherein, prior to the start of the folding operation, the stop (24) is moved from the folding channel (5) toward at least one said folding knife (2, 3).

10. The method as claimed in claim 8, wherein the work transfer device (14), in the counterpressure mode, is moved essentially with a constant counterpressure force (G) against the folding pressure (D).

11. A knife folding machine (1) for producing standing folds (26) in a material web (4) fed in a folding direction (F), having at least two folding knives (2, 3), which are situated one opposite the other with respect to the material web (4) and having a folding channel (5) extending from the folding knives (2, 3) in the folding direction (F), which comprises a work transfer device, which, in an ejection mode, has a stop (24) which juts into at least a part of the projection area, in the folding direction (F), of the standing folds (26) in the folding channel (5) and which is configured such that it can be driven through the folding channel (5) in the folding direction (F), wherein the work transfer device (14)is configured such that it can be moved in front of the folding knives (2, 3) in the folding direction (F).

12. The knife folding machine as claimed in claim 11, wherein the work transfer device (14) is configured such that it can be transferred from the ejection mode into a folding operation mode, in the folding operation mode the stop (24) being disposed essentially outside the projection area, in the folding direction (F), of the standing folds (26) in the folding channel (5).

13. The knife folding machine (1) as claimed in claim 11, wherein the work transfer device (14) is configured such that it can be transferred into a counterpressure mode, in which case, in the counterpressure mode, during the folding motion of the folding knives (2, 3), a counterpressure force (G) can be generated, which is directed counter to the folding direction (F) and acts upon at least the standing folds (26) in the folding channel (5), and the work transfer device (14) is configured such that it can be deflected from the standing folds (26) in the folding direction (F).

14. The knife folding machine (1) as claimed in claim 13, wherein, the counterpressure mode, said stop (24) juts into the projection area of the standing folds (26) in the folding channel (5) in the folding direction (F).

15. The knife folding machine (1) as claimed in claim 11, wherein a control unit (10) is provided, by which the work transfer device (14) can be moved with an essentiaily constant drive force.

16. The knife folding machine as claimed in claim 11, wherein the stop (24) is configured as a bar extending over the folding channel (5) essentially transversely to the following direction (F).

17. The knife folding machine (1) as claimed in claim 11, wherein the work transfer device (14) has a slide (15) which can be moved essentially along the folding channel (5) and to which the stop can be attached.

18. The knife folding machine (1) as claimed in claim 11, wherein the height of the stop (24) can be adjusted to the height (H) of the folding channel (5).

* * * * *

UNITED STATES PATENT AND TRADEMARK OFFICE

CERTIFICATE OF CORRECTION

PATENT NO. : 7,510,518 B2
APPLICATION NO. : 11/131588
DATED : March 31, 2009
INVENTOR(S) : Arno Heinen et al.

It is certified that error appears in the above-identified patent and that said Letters Patent is hereby corrected as shown below:

Column 7, Line 20: Delete “26”.

Column 8, Line 44: Delete “a”.

Column 10, Line 18: Delete “following” and substitute --folding--.

Signed and Sealed this

Nineteenth Day of May, 2009

JOHN DOLL
*Acting Director of the United States Patent and Trademark Office*